US006250547B1

(12) United States Patent
Yamai

(10) Patent No.: US 6,250,547 B1
(45) Date of Patent: Jun. 26, 2001

(54) CASH REGISTER HAVING SAWTEETH SHAPED CIRCULAR PERFORATOR

(75) Inventor: Toshiaki Yamai, Kanagawa Prefecture (JP)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 09/339,757

(22) Filed: Jun. 24, 1999

(30) Foreign Application Priority Data

Jul. 6, 1998 (JP) ..... 10-190534

(51) Int. Cl.[7] ..... G07G 1/00
(52) U.S. Cl. ..... 235/7 R; 235/432; 283/60.1
(58) Field of Search ..... 235/7 R, 432, 235/462.01, 383, 13, 433; 283/60.2, 60.1

(56) References Cited

U.S. PATENT DOCUMENTS 1,011,549 * 12/1911 Yantis ..... 283/62
1,380,081 * 5/1921 Saunders ..... 283/62
3,042,426 * 7/1962 Cohen ..... 283/62
3,790,757 * 2/1974 Shaw ..... 235/61.12
3,801,774 * 4/1974 Michaelis et al. ..... 235/61.6
3,850,068 * 11/1974 Bradam ..... 83/529
4,723,794 * 2/1988 Shannon ..... 283/60
5,887,903 * 3/1999 Schreadley, Jr. ..... 283/60.2
5,978,772 * 11/1999 Mold ..... 705/16
6,090,218 * 7/2000 Brackmann et al. ..... 134/15

* cited by examiner

*Primary Examiner*—Michael G. Lee
*Assistant Examiner*—Daniel St. Cyr
(74) *Attorney, Agent, or Firm*—Charlene Stukenborg

(57) ABSTRACT

A cash register including printing means for printing receipt information onto one area of a roll sheet and added-value information onto another area of the sheet; perforator means for rendering, as the sheet is fed, the printed area of the receipt information and the printed area of the added-value information in a readily separable state; and cutting means for cutting out the printed sheet from the roll sheet, so as to issue the cut sheet as a receipt provided with the added-value information is provided. Further, the perforator means comprises a circular blade having a saw-teeth shape and coaxially mounted on a roll sheet feeding shaft arranged on the way of the traveling path of the sheet, so as to form, as the sheet travels, a perforation-shaped cutting along a boundary line between the printed areas of the sheet.

4 Claims, 4 Drawing Sheets

FIG. 4

ABC SHOP

THANK YOU FOR YOUR REPETITIVE PURCHASE.
WAITING FOR YOUR COMING AGAIN.

JUNE 20, 1998

3 : 00 P.M.

COUNTER = 2.

| | | | |
|---|---|---|---|
| COCA COLA | @¥110 Li | ES | :1 |
| CARAMEL | @¥110 Li | | :2 |
| ORANGE | @¥500 _i | ES | :3 |
| BANANA | @¥250 _i | | :4 |
| MILK | @¥200 _i | | :5 |
| BREAD | @¥300 Li | | :6 |

• • • •

• • • •

| | |
|---|---|
| SUB - TOTAL | ¥4,680 |
| CONSUM. TAX | ¥ 234 |
| TOTAL | ¥4,914 |
| RECEIVED MONEY | ¥5,000 |
| CHANGE | ¥ 86 |

DELIGHTFUL LUCKY LOTTERY NUMBER

NO. 1513111

FIRST PRIZZ: TOUR TO GUAM
SECOND PRIZE: MERCHANDISE COUPON OF ¥1,000
THIRD PRIZE: STEAMED CHINESE DOUGH

CASH REGISTER HAVING SAWTEETH SHAPED CIRCULAR PERFORATOR

BACKGROUND OF THE INVENTION

This invention relates to a cash register, and more particularly to one having a printing mechanism constituted to print added-value information onto a receipt upon issuance thereof.

Cash registers or POS terminals (to be collectively referred to as "cash register" hereinafter) have been used in retail shops, and include a receipt printing device for printing information, such as sales itemization information about goods and/or services, onto a receipt to be issued to a customer.

Such a receipt is typically printed with receipt information such as a name or logo representing the receipt issuing shop, an issuing date, items of purchased goods and/or services, unit price thereof, and amounts of received money and change.

A receipt may serve as an advertising medium. Thus, in addition to a simple name of shop, logo, or a regular message and the like, receipt printers have printed added-value information, such as an informative advertisement of special sale article and date thereof, a service-point to be given in proportion to the amount of purchase, a coupon, and/or a lottery ticket pattern on a receipt.

The aforementioned added-value information has conventionally included a shop name and/or logo to be printed before the receipt itemization area, and other information to be printed thereafter. However, when the added-value information to be printed together with the receipt information is a service-point to be given in proportion to the amount of purchase, a coupon, and/or a lottery ticket pattern, it has become troublesome to deal with the receipt since the receipt serves both receipt and added-value functions.

Namely, an inherent function of a receipt is to be kept by adhering it onto a household account book, or to be preserved for at least a predetermined period of time in compliance with a requirement of accounting or taxation. As such, when a receipt is printed with the aforementioned lottery ticket pattern or coupon which may be later submitted to the issuing shop, it has been troublesome to preserve the receipt and/or it has been required to cut the received one-piece receipt into a receipt information printed portion and an added-value information printed portion, such as by means of scissors.

SUMMARY OF THE INVENTION

The present invention provides a cash register comprising: sheet feeding means for unrolling a roll sheet housed in a housing part to thereby feed a sheet; printing means for printing receipt information to be issued to a customer onto a first area of the sheet and added-value information onto a second area of the sheet; perforator means for rendering, as the sheet is fed, the first printed area and the second printed area into a readily separable state, and cutting means for cutting out the printed sheet from the roll sheet, so as to issue the cut sheet as a receipt provided with said added-value information.

Further, the perforator means comprises a circular blade having a saw-teeth shape and being coaxially mounted on a roll sheet feeding shaft arranged on the way of the traveling path of the sheet. As the sheet travels, the circular blade creates a perforation-shaped cutting along a boundary line between the printed areas of the sheet.

In this way, the present invention has solved the aforementioned problems by providing an issued single receipt which possesses both receipt function and added-value information function, by printing the receipt information onto a first area and the added-value information onto a second area of the surface of the sheet such that the receipt information printing area and the added-value information printing area are isolated or distinguished in the lateral direction, and by rendering the receipt information printed area and the added-value information printed area to be in a readily separable state.

BRIEF DESCRIPTION OF THE DRAWINGS

FIG. 4 is a view showing an example of a receipt issued by the cash register according to the present invention.

DETAILED DESCRIPTION

There will be described hereinafter the preferred embodiment according to the present invention, with reference to the accompanying drawings.

Figure 1:
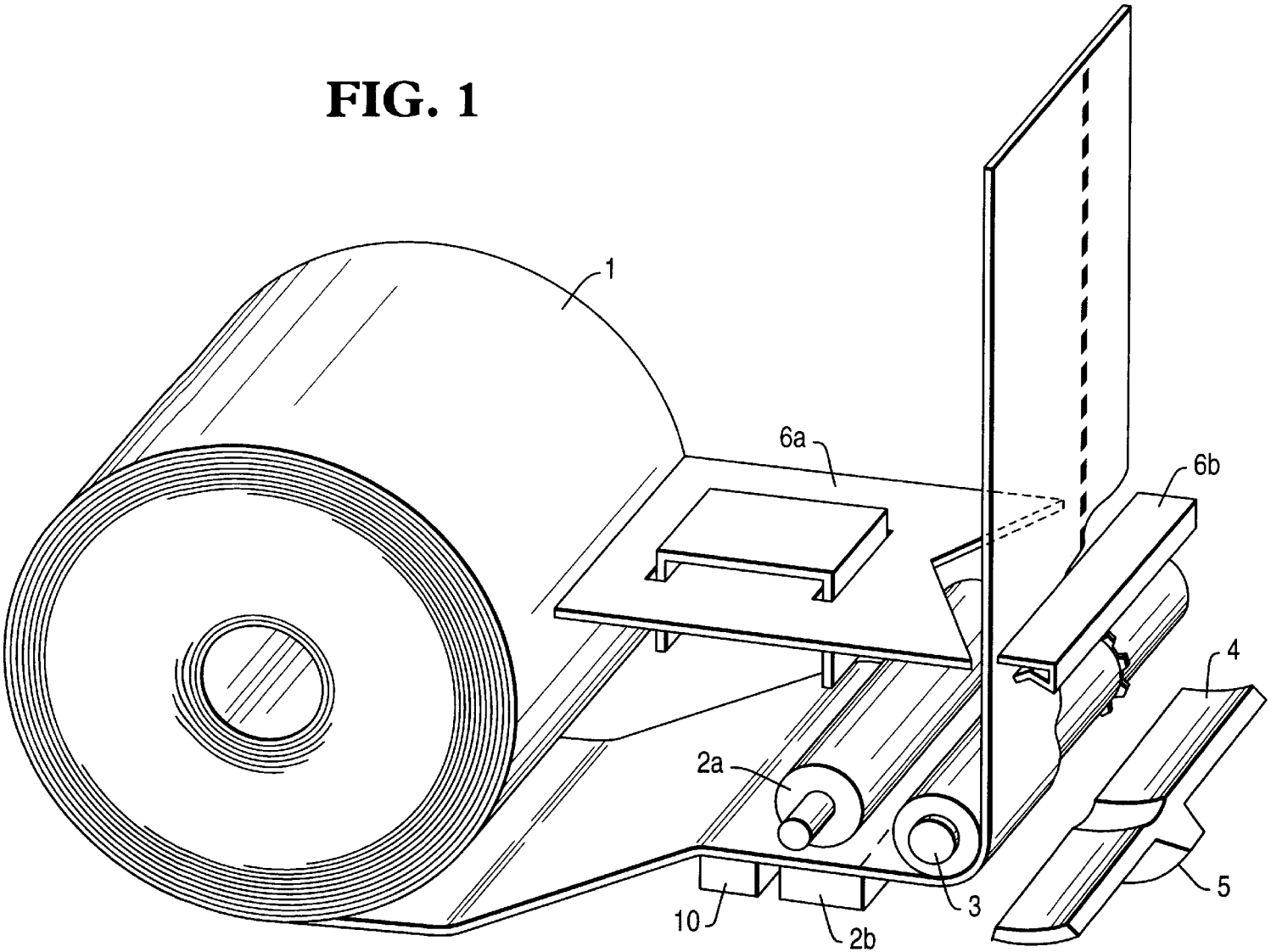
FIG. 1 is a perspective view of interior parts of a cash register according to the present invention.
Figure 2:
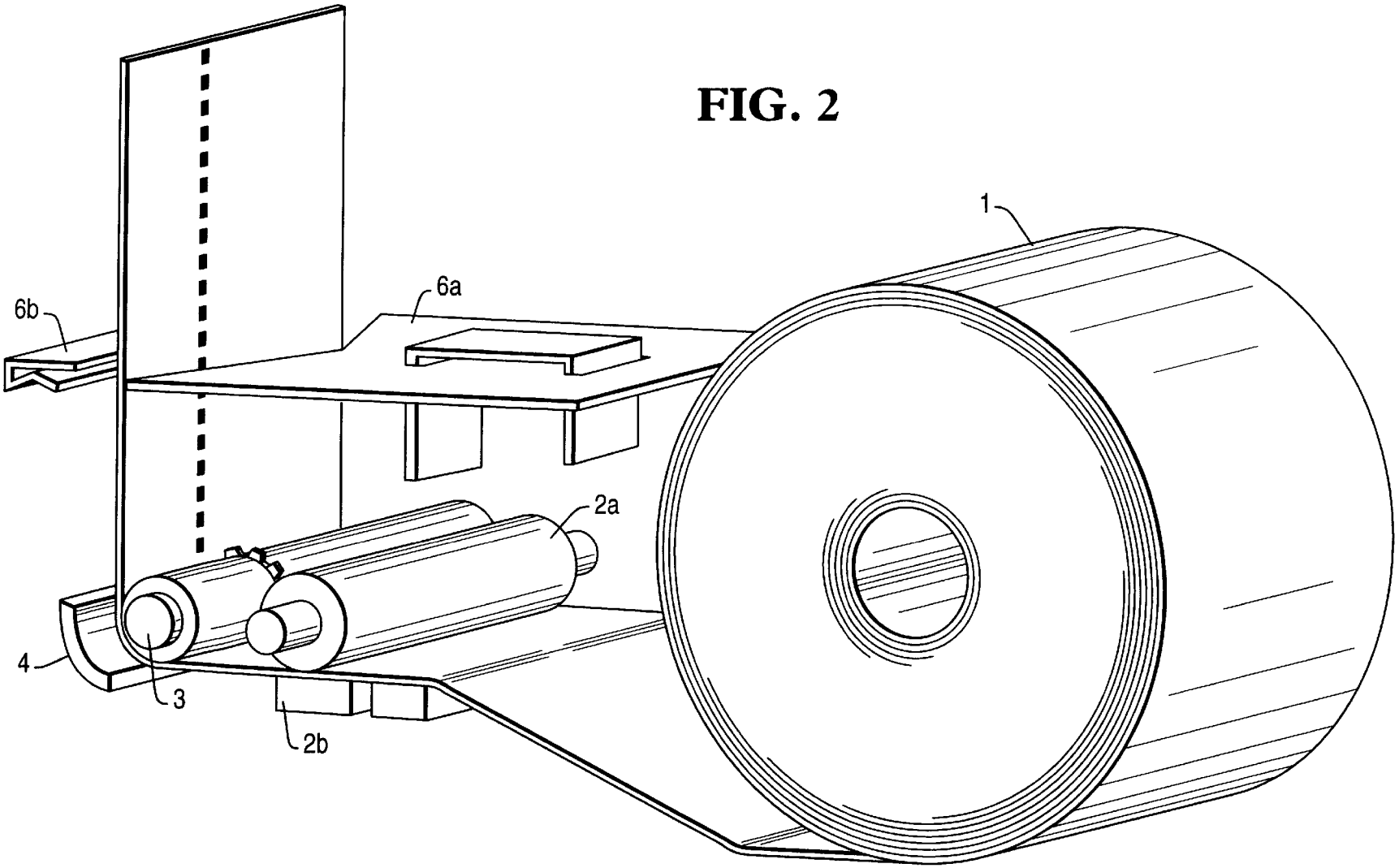
FIG. 2 is an opposite side perspective view of FIG. 1.

FIG. 1 is a perspective view of interior parts of a cash register according to the present invention, and FIG. 2 is an opposite side perspective view of FIG. 1.

Reference numeral 1 designates a roll sheet housed in a roll sheet housing part within a cash register, and the sheet 1 is fed along a sheet traveling path and reaches a printing device. At a predetermined position on the way of the sheet traveling path, there are provided such as a feeding roller, a feeding guide and a driving mechanism (all not shown), for feeding the roll sheet 1.

The roll sheet 1 is utilized to be printed with: receipt information such as sales itemization at one area in the lateral direction of the receipt; and with added-value information such as an informative advertisement of a special sale article and date thereof, as well as a service-point to be given in proportion to the amount of purchase, a coupon, and/or a lottery ticket pattern, at the other area in the lateral direction of the receipt. As such, the sheet has a width wider than the conventional receipt sheet. In this embodiment, the receipt information and the added-value information are printed onto the left and right sides when viewed in a usual manner, respectively. The receipt printing area is printed with a shop name and/or logo; a simple regular message; a receipt issuing date; a list of goods and/or service which serves as the sales itemization of the goods and service; a unit price and the number of goods; received money; change; and the amount of consumption tax. The added-value printing area is printed with a service-point and/or a lottery ticket pattern.

The printing of the receipt information and the added-value information by the printing device are performed in the same row. Namely, when the printing device is a thermal type which uses heat transfer printing, there is simultaneously printed a row into both the receipt area and the added-value information area. Further, in case the printer is a dot impact system or an ink jet system, printing head 2*b* is laterally driven so as to print onto the receipt printing area and the added-value printing area of the roll sheet 1. In either case, sheet feeding means feeds a row amount of roll sheet 1 whenever a row is printed. In the present invention, it is possible to adopt any printing means including an ink jet system or laser printing system in addition to the dot impact system or heat transfer printing system.

As shown in FIG. 4, the added-value information of this embodiment is printed by utilizing the feeding direction of the sheet to create a row, so that the row and column of the added-value information are opposite to or perpendicular to those of the receipt information printing. Such printing may be performed as a function of a printing device inherently mounted in the cash register.

The printing device is provided with a printing head (heat transfer printing type of printing head 2*b* in the drawing) and a platen 2*a* positioned oppositely to the printing head to thereby interposingly support the roll sheet 1 therebetween. In this embodiment, the platen 2*a* also functions as a feeding roller for feeding the roll sheet 1. The platen 2*a* may be of course provided separately from a feeding roller.

It is usually possible to stampingly print a name of shop and/or logo as well as a simple regular message at an upper portion of a receipt sheet to be issued to a customer. To this end, there is provided an electric stamp 10 between the roll sheet housing part and the printing device. This electric stamp 10 may be located at another position on the way of the sheet traveling path.

After being printed with the receipt information and the added-value information, the roll sheet 1 is further conveyed forwardly so as to pass through perforator means 3 arranged at this side of receipt cutting means 6.

Figure 3:
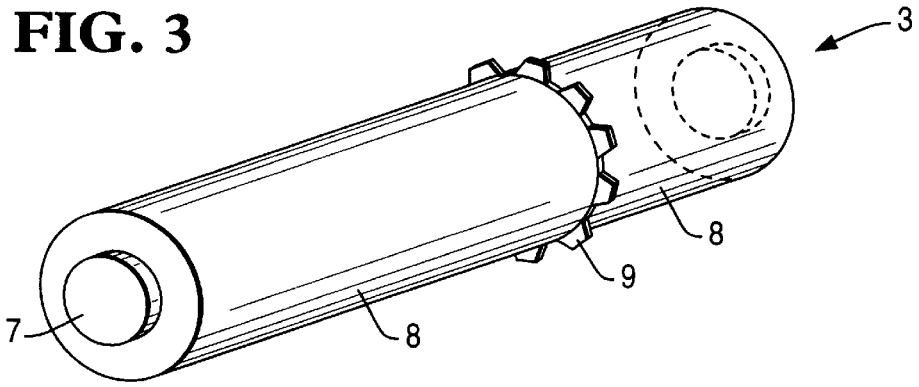
FIG. 3 is a perspective view showing a constitution of perforator means.

FIG. 3 is a perspective view showing a constitution of the perforator means 3. The perforator means 3 includes a roll sheet feeding shaft 7 arranged on the way of the traveling path of the roll sheet 1, a circular blade 9 of a saw-teeth shape, and a rubber roller 8, both mounted around the rotating axis of the shaft 7. The circular blade 9 is arranged at a position of a boundary line between the receipt information printing area and the added-value information printing area of the traveling roll sheet 1. In this embodiment, the perforator means 3 also functions as the feeding means, such that the roll sheet 1 is fed as the perforator means 3 rotates.

The periphery of the circular blade 9 of the perforator means 3 is formed with saw-teeth. The saw-teeth have troughs retracted radially inwardly of the circumferential surface of the rubber roller 8 so as not to contact with the traveling surface of the roll sheet 1, and apexes projected radially outwardly from the circumferential surface of the rubber roller 8. In this way, only the apexes of the saw-teeth will penetrate the traveling roll sheet 1, to thereby provide a cutting of a sawing machine perforation shape along the boundary line between the receipt information printing area and the added-value information printing area.

In the present embodiment, it is arranged that the receipt piece is located at the left side of the traveling direction, and the added-value sheet piece to be printed such as with a service-point, coupon, and/or a lottery ticket pattern is located at the right side of the traveling direction. However, it is of course possible to exchange their locations with each other.

As the roll sheet 1 passes over the installed position of the perforator means 3, the circular blade 9 is rotated with the rotation of the roll sheet feeding shaft 7, such that the apexes of the saw-teeth penetrate the roll sheet 1 to thereby provide the perforations at the predetermined position parallel to the traveling direction of the roll sheet 1. There is further provided a roll sheet guiding member 4 at a position opposing to the circular blade 9 while interposing the roll sheet 1 therebetween. The roll sheet guiding member 4 is capable of urging the roll sheet 1 from its back surface toward the circular blade 9 at the perforator means 3, to thereby facilitate the provision of the perforations to the roll sheet 1.

The saw-teeth of the circular blade 9 at the perforator means 3 is thinly shaped of a material such as metal or ceramics, to smoothly provide the perforations to the roll sheet 1. The pitch and interval of the perforations are determined correspondingly to the shape of the saw-teeth.

When the saw-teeth of the circular blade 9 add the perforations to the roll sheet 1, there will inevitably accompany paper dust. If left alone, the paper dust will affect detective operation of an optical detector arranged within the cash register, resulting in a cause of trouble in the cash register. As such, the roll sheet guiding member 4 is preferably provided with a paper dust collecting cover 5. This paper dust collecting cover 5 should be periodically cleaned out such as at the time of supplementation of the roll sheet 1.

FIG. 4 shows a printed roll sheet 1 provided with the perforations at the boundary line of the receipt portion and the added-value information portion, after printing.

The sheet as printed and formed with the perforations by the perforator means 3 is cut by the receipt cutting means, which has a cutter assembly 6*a* and a cutter acceptor 6*b*, and then issued from an outlet toward the exterior of the cash register. With the embodiment of FIG. 4, the customer is encouraged to separate the receipt into two portions and preserve them, one as a receipt and the other as a lottery ticket.

Figure 5:
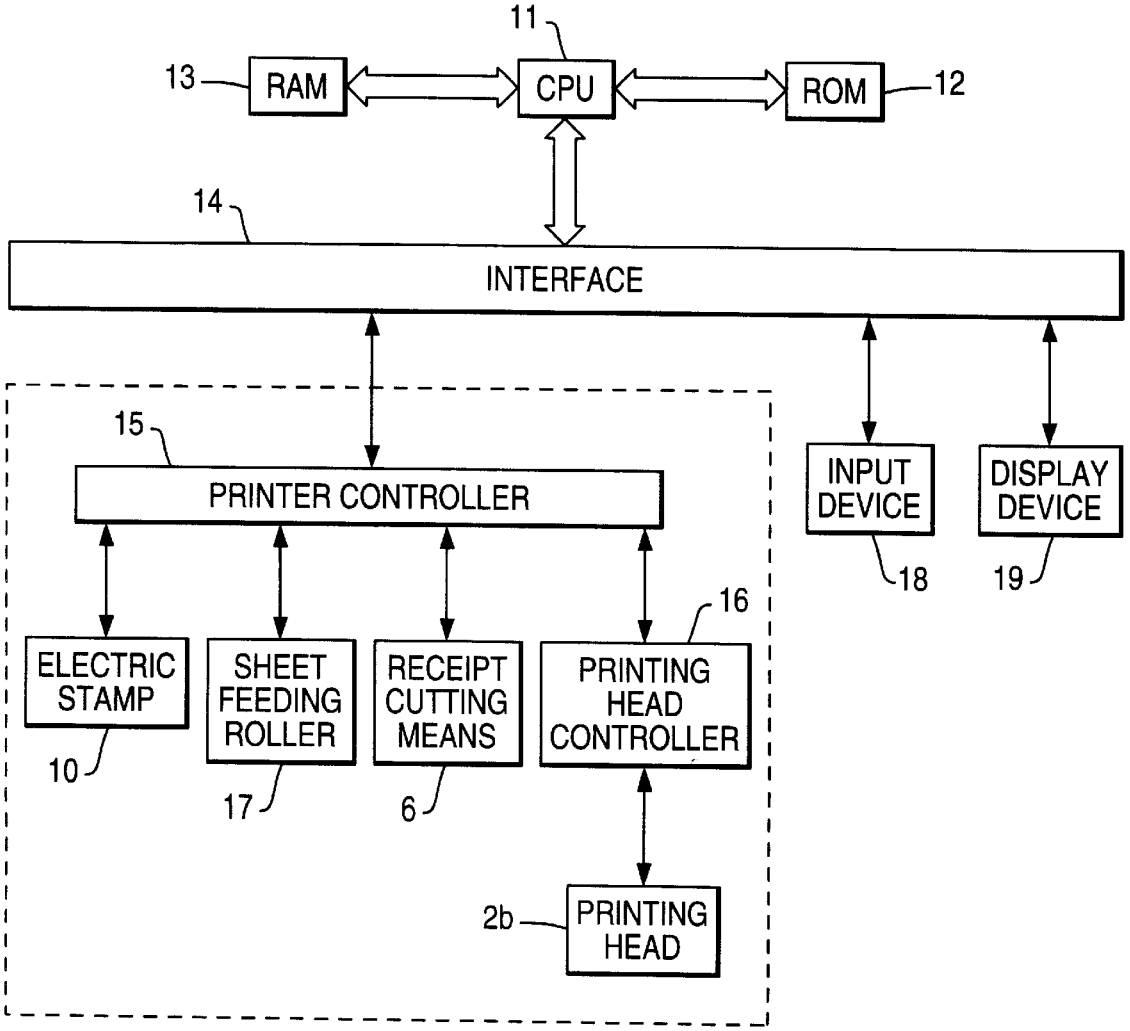
FIG. 5 is a block diagram of controlling block of the cash register.

FIG. 5 shows a block diagram for controlling the cash register as constituted in the aforementioned manner. 18 Connected to a central processing unit (referred to as "CPU" hereinafter) 11 are a ROM 12 recorded such as with a program and constant data, and a RAM 13 for temporarily storing variable data. Further connected to the CPU 11 via interface 14 is a printer controller 15. This printer controller 15 is connected to a printing head controller 16 for controlling the printing head 2*b*; the electric stamp 10; a roll sheet feeding roller 17 for feeding the roll sheet 1; and the receipt cutting means 6; to thereby control their operation.

Connected to the CPU 11 via interface 14 are an input device 18 for entering necessary information such as by alphanumeric keys or bar-code scanner, and a display device 19 for displaying items and the prices thereof based on the entered necessary information. In case of entrance of codes of goods by means of a bar-code scanner, the CPU 11 will access to a price reference list file (PLU file) such as stored in an external in-store processor, to thereby read out the name of the goods and the price thereof according to the goods code via an in-house communication line, so as to display the data as read out and to print the same onto the roll sheet 1 by the printing device. The printing is performed in a predetermined manner such that the first area and the second area of the roll sheet 1 are printed with the receipt information and the added-value information, respectively.

The thus printed roll sheet 1 is given with the perforations by the perforator means 3 along the boundary line between the receipt information printing area and the added-value information printing area.

The sheet as provided with the perforations is cut by the receipt cutting means 6, and then issued from an outlet toward the exterior of the cash register.

The preferred embodiment according to the present invention has been described, but variations and modifications thereof other than the above described embodiment are possible within the scope of the present invention.

In the cash register according to the present invention as described above, there is adopted the single receipt printing device for printing the receipt information to be issued to the customer onto one area and the added-value information onto another area of the sheet surface, respectively, and the perforations are formed along the boundary line between the printed area of the receipt information and that of the added-value information, such that the sheet is put in a state in which the same can be readily separated into right and left pieces, thereby enabling a customer to readily deal with the single piece of sheet when the same is provided with both of a function of a receipt and a function of added-value information.

The cutting insertion of the perforations for the sheet is effected by the rotation of the circular blade having a saw-teeth shape as mounted to the sheet feeding means provided on the way of the sheet traveling path, so that the cutting insertion of the perforations can be easily and assuredly effected without requiring any special mechanism.

What is claimed is:

1. A cash register comprising:

sheet feeding means for unrolling a roll sheet housed in a housing part to thereby feed a sheet;

printing means for printing receipt information to be issued to a customer onto a first area and added-value information onto a second area of a surface of said sheet being fed;

perforator means for rendering, as said sheet is fed, said first printed area of said receipt information and said second printed area of said added-value information to be in a readily separable state, wherein said perforator means comprises a circular blade having a saw-teeth shape and coaxially mounted on a roll sheet feeding shaft arranged along a traveling path of said sheet, so as to form, as said sheet travels, a perforation-shaped cutting along a boundary line between said first and said second printed areas of said sheet, and cutting means for cutting out said printed sheet from said roll sheet, so as to issue said cut sheet as a receipt provided with said added-value information.

2. The cash register of claim 1, wherein said second area of said sheet printed with said added-value information is adapted to serve as a coupon, a service ticket according to a total amount of purchase, lottery ticket pattern, or adapted to indicate advertisement or guiding information.

3. The cash register of claim 1, wherein said printing means is of a type selected from a group consisting of dot impact system, heat transfer printing system, ink jet system or laser printing system.

4. A method of providing both receipt information and added value information to a customer in a readily separable state, comprising the steps of:

printing receipt information onto a first area and added-value information onto a second area of a surface of a sheet wound in a roll;

perforating a boundary line between the first area and the second area rendering the sheet in a readily separable state, including the substep of rotating a circular blade having a saw-teeth shape and coaxially mounted on a roll sheet feeding shaft along a traveling path of the sheet to form a perforation-shaped cutting along the boundary line as the sheet travels; and cutting the printed sheet from the roll sheet so as to issue the cut sheet as a receipt provided with the added-value information.

* * * * *